US007550661B1

(12) United States Patent
Willis

(10) Patent No.: US 7,550,661 B1
(45) Date of Patent: Jun. 23, 2009

(54) D-TUNER FOR BANJO

(76) Inventor: W. Coy Willis, 22161 Stipps Hill Rd., Laurel, IN (US) 47024

( * ) Notice: Subject to any disclaimer, the term of this patent is extended or adjusted under 35 U.S.C. 154(b) by 0 days.

(21) Appl. No.: 11/897,344

(22) Filed: Aug. 30, 2007

(51) Int. Cl.
*G10D 3/00* (2006.01)

(52) U.S. Cl. ..... 84/318; 84/173; 84/269; 84/270; 84/297 R; 84/290; 84/300; 84/303; 84/304; 84/305; 84/306; 84/308; 84/315; 84/317; 84/329; 84/454

(58) Field of Classification Search ..... 84/173, 84/270, 297 R, 329, 454, 269, 300, 318, 308, 84/303–306, 290, 315, 317
See application file for complete search history.

(56) References Cited

U.S. PATENT DOCUMENTS 3,903,776 A * 9/1975 Owen, III ..... 84/318
4,151,778 A * 5/1979 Beattie et al. ..... 84/306
4,408,515 A * 10/1983 Sciuto ..... 84/267
4,528,887 A * 7/1985 Frederick ..... 84/306
4,768,416 A * 9/1988 Boyer ..... 84/453
5,033,349 A * 7/1991 Nechville ..... 84/272
5,131,307 A * 7/1992 Castillo ..... 84/267
5,171,927 A * 12/1992 Kubicki et al. ..... 84/304
5,728,955 A * 3/1998 Sperzel ..... 84/306
6,107,554 A * 8/2000 Riddle ..... 84/300
6,114,617 A * 9/2000 Scheib ..... 84/312 R
2006/0042452 A1* 3/2006 Brown ..... 84/455
2006/0048626 A1* 3/2006 Box et al. ..... 84/304

OTHER PUBLICATIONS

Frank Ford, Nov. 7, 2001, "Bluegrass Banjo in the '60s".*

* cited by examiner

*Primary Examiner*—Jeffrey Donels
*Assistant Examiner*—Kawing Chan
(74) *Attorney, Agent, or Firm*—Eckert Seamans Cherin & Mellott, LLC; David V. Radack, Esq.

(57) ABSTRACT

A D-Tuner for mounting on the peghead of a banjo. The D-Tuner has keyed cam pegs, adjustable stops for limiting the extent of rotation of the cam pegs, and linear flexible members attached to the cam pegs. The flexible members are suitable for attachment to the second B string and third G string of a banjo for tuning the banjo when the keyed cam pegs are turned.

26 Claims, 8 Drawing Sheets

D-TUNER FOR BANJO

FIELD OF THE INVENTION

This invention relates to a mechanical device for tuning and/or dynamically changing the pitch on a banjo easily, quickly and accurately.

BACKGROUND OF THE INVENTION

The practice of dynamically changing the pitch of the strings on a banjo to create a unique sound, commonly called "slurring", goes back many years. The first method used was that the musician simply grabbed the string by hand, pulled on it, and used his ears to detenmine how far to pull the string.

A mechanical device that does the same thing became known as a D-Tuner. With a D-Tuner, you can not only slur the strings, you can change the tuning of the banjo form the normal G tuning to D tuning. There are two reasons for changing to D tuning. First, you simply want to play a song in D and second, to use the D-Tuner to temporarily play the D Chord without having to fret the strings while playing a song that is played in the key of G. In the process of changing the tuning, the musician normally slurs the strings going down to produce the tones for the D chord then slurs it going back up to the G chord or G tuning. In some cases the slurring is a quick motion of down and back up immediately. In other cases they vary the speeds to produce unique slurring sounds.

Earl Scruggs was probably the first known banjo player to use a mechanical D-tuner, around 1940. Since that time, there have been untold numbers of all sorts of mechanical devices to perform that function, varying from the crudest of devices to very fancy and very expensive custom made devices. It's unlikely that any of these devices were ever produced commercially. All of these devices were attached to the top side of the banjo's peghead and used some sort of cam device to push and deflect the strings sideways. There were many reasons why these devices never became commercial. The barriers to commercializing included, among others, high production costs, poor performance, poor functionality, inaccuracy, undesirable appearance, and the requirement to drill holes in the sacred cow, the peghead.

The first D-Tuner to go commercial appeared around 1970 and is known generally as the Keith tuner. The Keith tuner addressed most of the disadvantages or problems of all previous tuners. It solved the problem of appearance and the need for drilling holes in the peghead by replacing the existing tuning pegs with a dual purpose tuner that could tune the string in the normal fashion and also perform as a D-Tuner. The Keith tuner did not however solve one important problem of performance. It is very difficult to set the stops properly and they have a definite tendency to slip out of tune. The user is caught between tightening the screws to tight and damage the tuner or tightening it too loose and damage it from slipping during use. The locking screws can also come loose and become lost along with the spring that is suppose to prevent them from coming off. This is evidenced by replacement screws and springs being listed in catalogues. Another disadvantage of the Keith tuner is that you cannot tweak the tuning of the strings without resetting both the up and down stops.

U.S. Pat. No. 7,109,405 to Brown addresses the functionality and reliability issues inherent in prior D-Tuners, as well as issue of holes in the peghead. The Brown patent discloses a D-Tuner having a base unit with a pair of projections extending upwardly from it and a bar for attachment to the base unit with the neck of a stringed instrument clamped between the base unit and the bar. The tuner includes tuning screws for moving the projections linearly to change string tension, a pair of externally threaded posts extending from a bottom surface of the base unit, and nuts to secure the tuner on the stringed instrument.

There is a need for a D-Tuner for a banjo or other stringed instrument, which does not detract from the aesthetic appearance of the banjo, which can be marketed at a reasonable price, which can be easily mounted on a banjo, and which can be used to easily, quickly and accurately tune the banjo.

SUMMARY OF THE INVENTION

This invention addresses the above described needs by providing a D-Tuner that is aesthetic pleasing, economical to manufacture, easy to mount on a banjo, and quick, easy and accurate to tune. The D-Tuner of this invention has two adjustable cammed keys secured in a base member and having linear flexible members such as wires attached to the cammed keys. The linear flexible members are adapted to extend through or around the side edges of the peghead for attachment to the second B string and third G string on the banjo. In one preferred embodiment of this invention, the flexible members are wires that are disposed in curved tubes that extend around opposite side edges of the peghead of a banjo. The D-Tuner has stops for controlling the extent of the adjustment of the tension of the strings when the keys on the D-Tuner are turned. A preferred embodiment of a D-Tuner of this invention has holes in the base of the tuner for receiving screws for mounting the D-Tuner on a banjo peghead.

An alternative embodiment of this invention avoids the use of screw holes drilled into the peghead by providing an alternate way to mount the tuner by attaching it using a VHB (Very High Bond) double sided tape. Acceptable tape is available from the 3M Company among other sources. This embodiment preferably includes some sort of adhesive seal/gasket over the open cavity on the mounting surface of the base. This seal or gasket prevents any contaminants from entering the working mechanisms of the tuner and blocks lubricants form reaching the peghead. The seal also acts as a tamper proof seal that must be broken in order to access the interior cams in the tuner. A broken seal provides evidence that someone has tampered with the tuner. Therefore the VHB double sided tape performs the above functions as well as a means to bond the tuner to the peghead and eliminate the need for holes Another alternative embodiment of this invention eliminates the tubes in which the wires are disposed and instead calls for small grooves to be cut in the banjo peghead for seating and guiding the wires that curve around the sides of the peghead and up to the banjo strings. In accordance with this embodiment, a standard peghead may have tiny rounded grooves, about 0.020 inch wide, cut in it that are practically invisible. Such grooves can be formed by burning them in by frictional sawing with a wound musical string that is rapidly drawn back and fourth along the line of the desired groove, like shining shoes, until smoke billows up to burn a perfectly rounded, almost invisible groove, especially after the surrounding blackened surface is eliminated as can easily done when making a new neck.

Another tubeless alternative embodiment calls for holes to be provided though a banjo peghead prior to the assembly of the peghead ears and peghead overlay on the peghead. With this embodiment, the D-Tuner is mounted on the peghead during assembly of the banjo.

Another tubeless embodiment is mounted on a banjo, which has the concave, rounded sides on the peghead in the location where the wires on the D-Tuner pass around the peghead whereby the wires of the D-Tuner will lie in the concave, rounded sides of the peghead.

BRIEF DESCRIPTION OF THE DRAWINGS

A full understanding of the invention can be gained from the following description of the preferred embodiments when read in conjunction with the accompanying drawings in which.

DESCRIPTION OF PREFERRED EMBODIMENTS OF THE INVENTION

The particulars shown and described herein are by way of example and for purposes of illustrative discussion of the embodiments of the present invention only and are presented to provide what is believed to be the most useful and readily understood description of the principles and conceptual aspects of the present invention. No attempt is made to show structural details of the present invention in more detail than is necessary for a fundamental understanding of the present invention. The description, taken with the drawings, makes apparent to those skilled in the art how the forms of the present invention may be embodied in practice.

Figure 1:
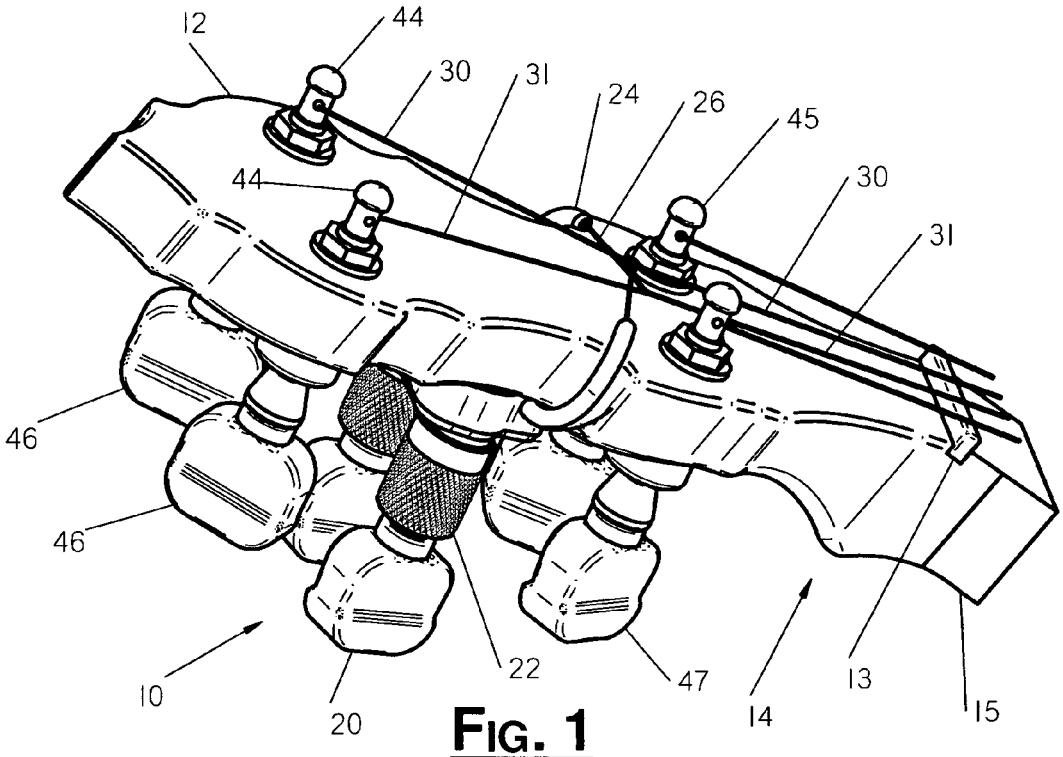
FIG. 1 is a perspective view of a D-Tuner of this invention mounted on a banjo peghead.
Figure 2:
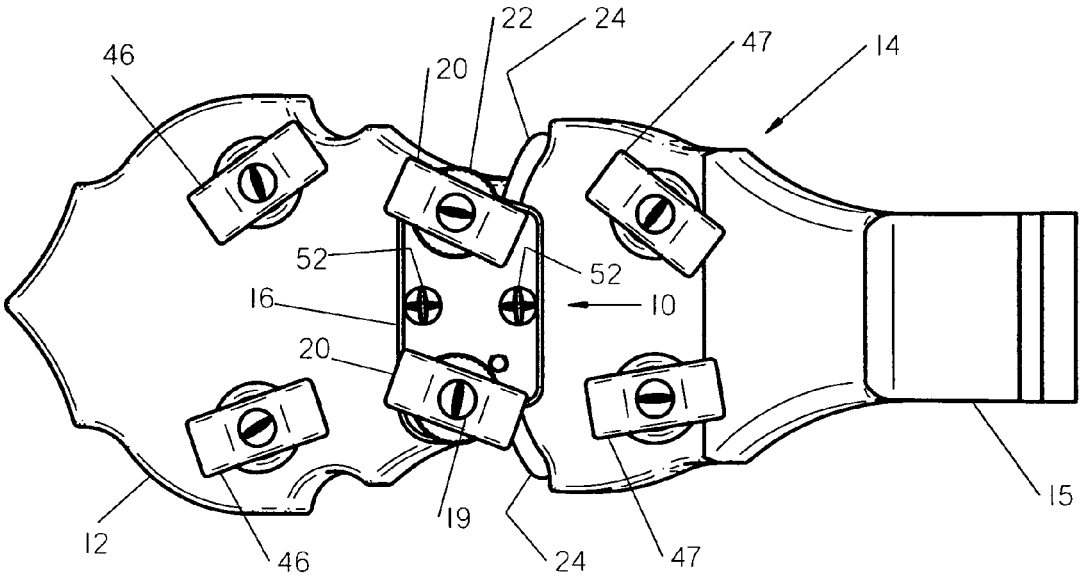
FIG. 2 is a plan view of a D-Tuner of this invention mounted on a banjo.
Figure 3:
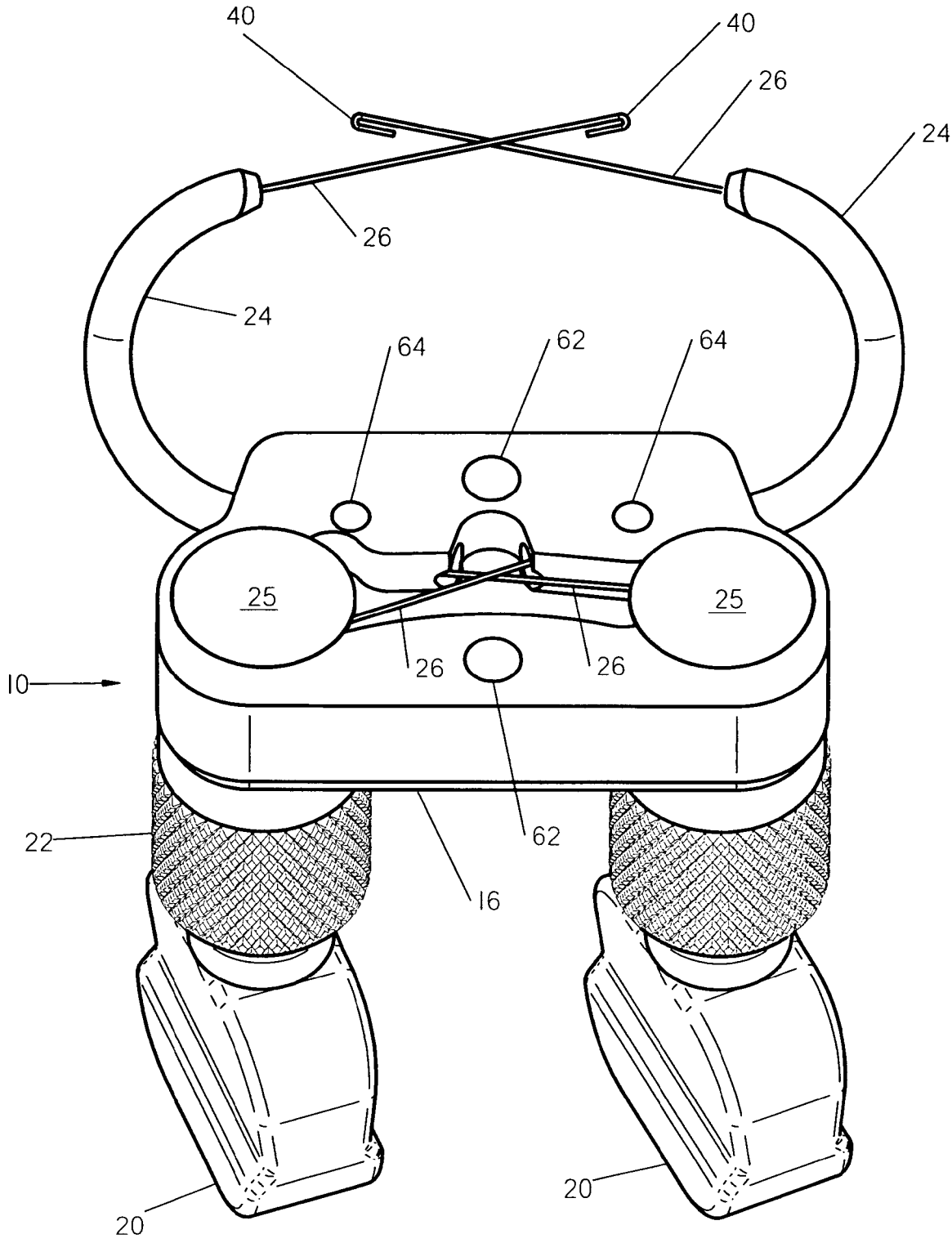
FIG. 3 is an enlarged perspective view of a D-Tuner of this invention prior to mounting it on a banjo.

Referring to the drawings, FIG. 3 shows a preferred embodiment of a D-Tuner 10 of this invention prior to mounting it on a banjo, and FIGS. 1 and 2 show the D-Tuner mounted on a peghead 12 of a banjo 14, only neck 15 and peghead of which are shown. The banjo 14 is a typical banjo with neck 15 having four tuning pegs 44, 45 with tuning buttons 46, 47 on them, and four strings 30-33 attached to the tuning pegs. The D-Tuner 10 has a base 16, two cam pegs 17, 18 (FIGS. 6-8 and 11) with tuning keys or buttons 20 on the pegs, two tubes 24 projecting from opposite sides of the base support, and wires 26 extending through each of the tubes. Screws 19 secure the buttons 20 on the cam pegs 18, which in turn secure the cam pegs in the base 16. Nuts 22 on the base support 16 function in setting the stops for the D-Tuner as is described below. As shown in FIG. 3, the D-Tuner 10 preferably has cover discs 25 made of metal or other material seated in countersink rims 42 to cover the cam and stop mechanisms in the pocket 16.

The tubes 24 extend from the base 16 around the opposite side edges of the peghead 12, and the wires 26 extend from the tubes to the second B string 30 and third G string 31 of the banjo 14. The wires 26 preferably have their ends formed (bent) into small u-shaped (180 degree) hooks 40 (FIG. 3) that are engaged over the strings 30, 31 to permit adjusting the tension in the strings when the wires are moved linearly in and out within the tubes 24 by turning the buttons 20.

Alternatively to the u-shaped hooks 40, small eyelets can be formed on the ends of the wires 26, 28 and the banjo strings 30, 31 threaded though the eyelets. The u-shaped hooks 40 are preferred over eyelets since eyelets are difficult to form and also difficult to thread through the tubes 24. The use of eyelets also requires that the strings 30, 31 must be removed from the tuning peg and pulled back through the eyelet in order to mount or dismount the D-Tuner 10. The tiny curl/hooks 40 on the ends of the wires 26 are inexpensive to manufacture and facilitate controlling the length of the wires 26. More important however is that it is much easier for the musician to replace strings when the wires 26 have hooks 40, whether it is in the normal setting or in an emergency setting such as breaking a string when performing on stage. All the musician needs to do is place the curl/hook 40 over the new string.

As best seen in FIG. 2, the D-Tuner 10 is preferably mounted on the banjo 14 on the centerline of the peghead 12 substantially centered between the tuning buttons 46, 47 and tuning pegs 44 and 45. The D-Tuner 10 may be secured to the peghead 12 by means of screws 52 or by very high bond double sided tape. The use of double sided tape avoids the need to make holes in the peghead 12 of the banjo to receive mounting screws.

The base 16 and nuts 22 of a D-Tuner 10 of this invention are preferably made of aluminum. The cam pegs 18 are preferably made of steel, and the tubes 24 are preferably made of brass, but the parts can also be made of other metals or materials such as high strength polymer. The wires 26 are preferably stainless steel or titanium, but can also be made of other high strength, non-elastic, flexible linear material such as other metals, polyester, fiberglass or carbon fibers. The keys or buttons 20 on the cam pegs 18 are preferably made of materials matching the keys 46, 47 on the banjo 14, such as mother of pearl or the like. The buttons 20 are secured on the cam pegs by screws 19.

Figure 4:
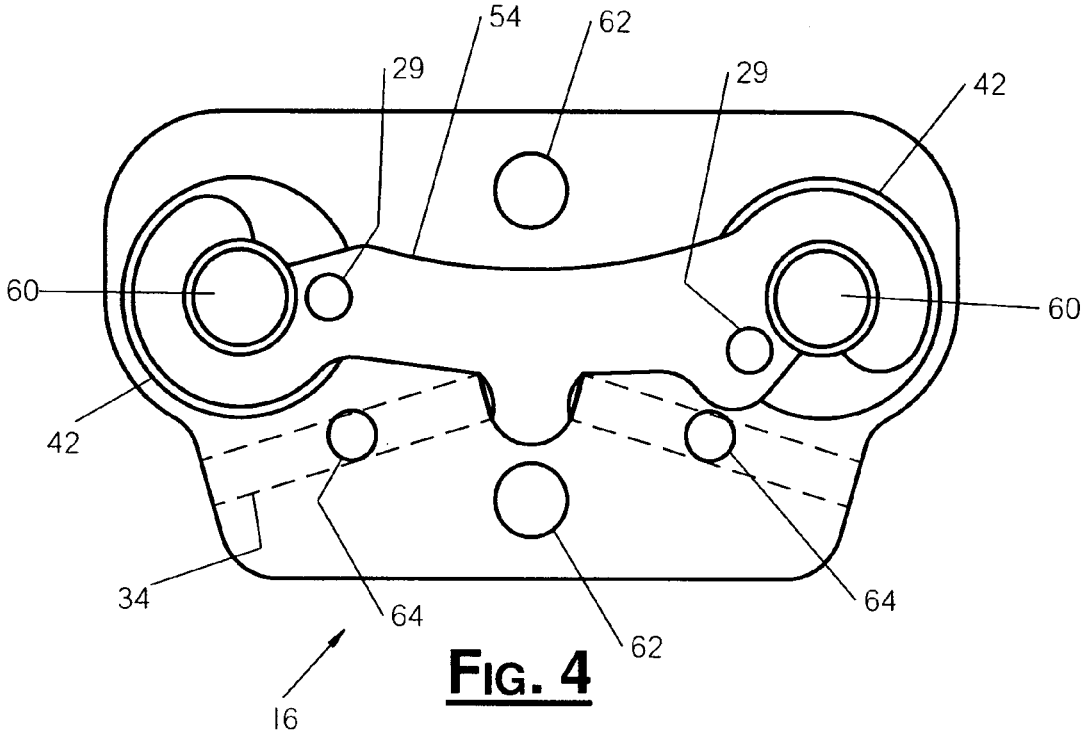
FIG. 4 is an enlarged bottom plan view of the base support for the D-Tuner of FIGS. 1-3 prior to assembly with the keys, tubes and wires.
Figure 5:
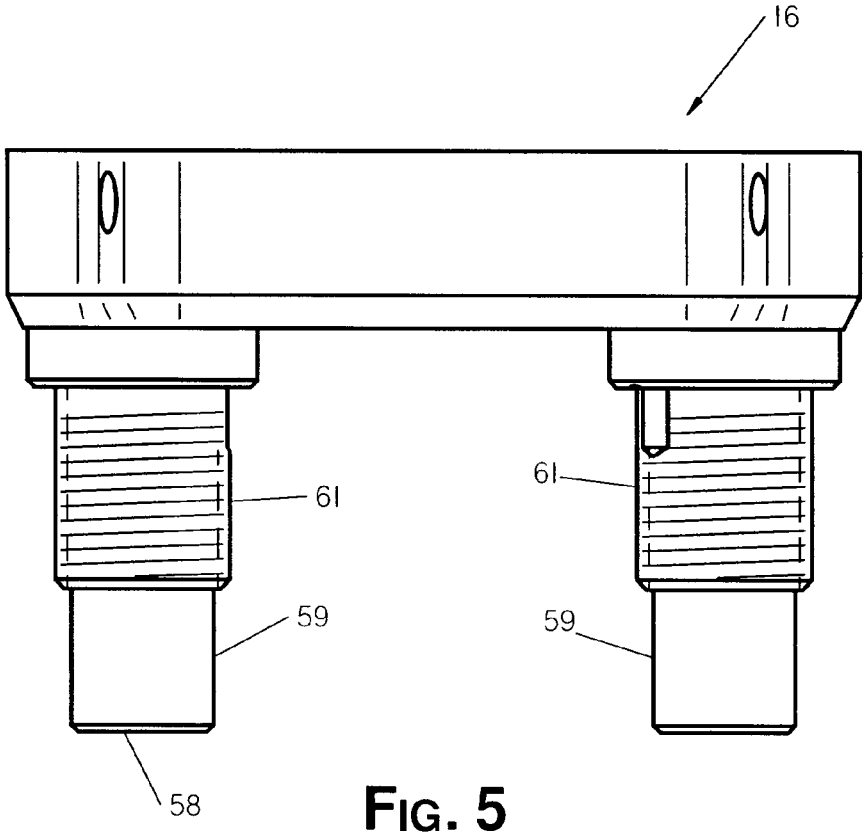
FIG. 5 is an enlarged side view of the base support of FIG. 4.
Figure 8:
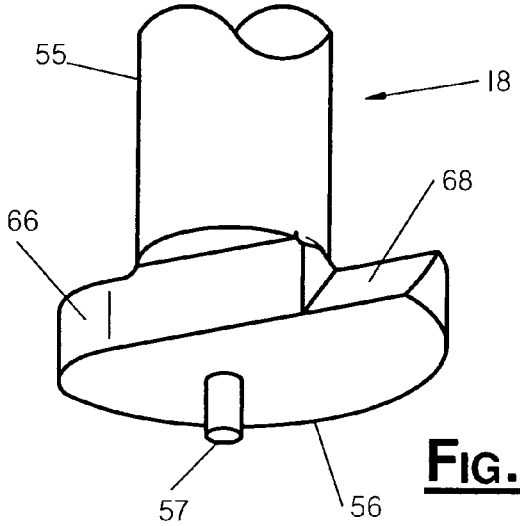
FIG. 8 is an enlarged fragmentary perspective view of the cam end of the cam peg of FIGS. 6 and 7.
Figure 9:
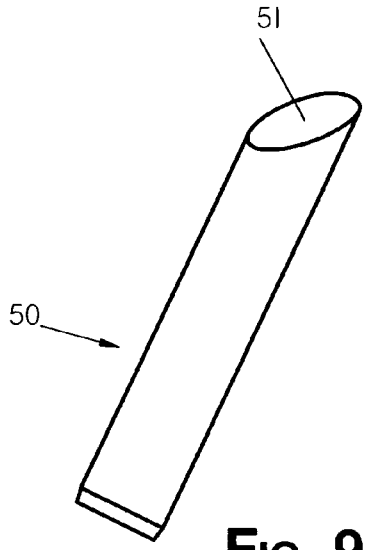
FIG. 9 is an enlarged perspective view of a stop pin for the D-Tuner of FIGS. 1-3.
Figure 7:
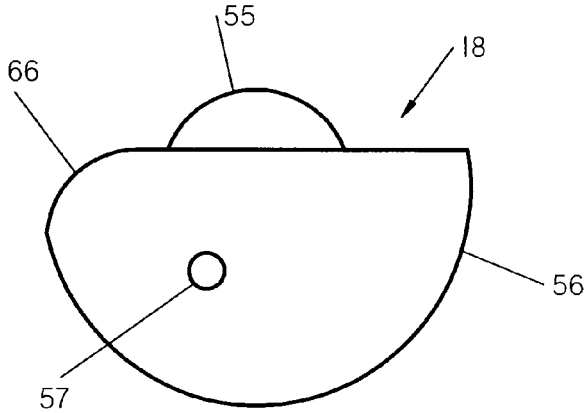
FIG. 7 is an enlarged end view of the cam peg of FIG. 6.
Figure 6:
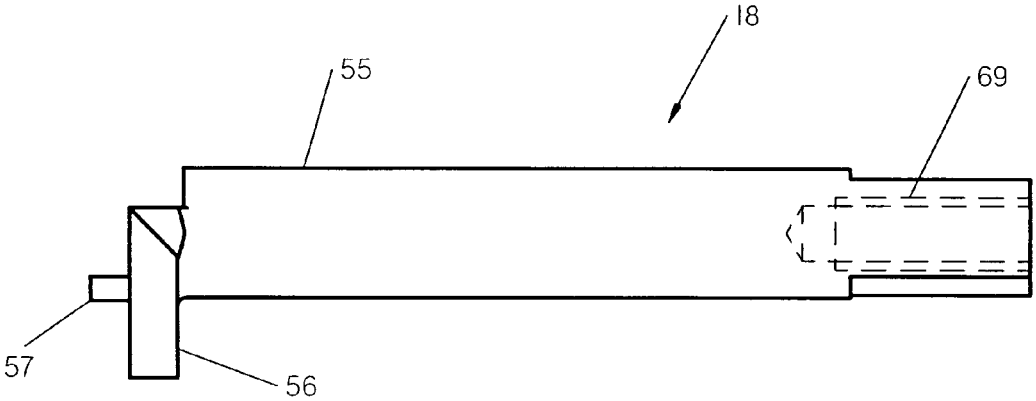
FIG. 6 is an enlarged side elevation view of a cam peg for a D-Tuner of this invention.
Figure 11:
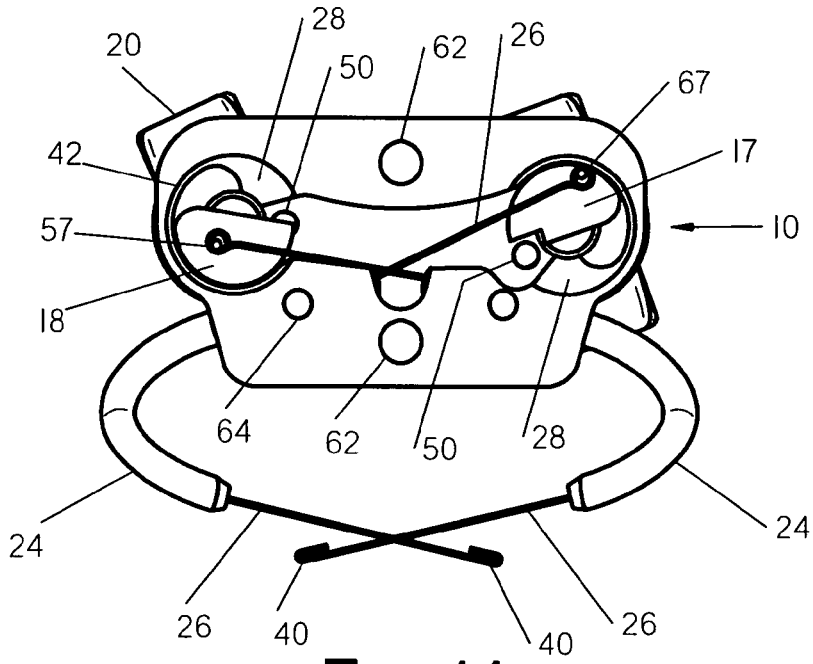
FIG. 11*s* a bottom plan view of the D-Tuner of FIGS. 1-3.
Figure 10:
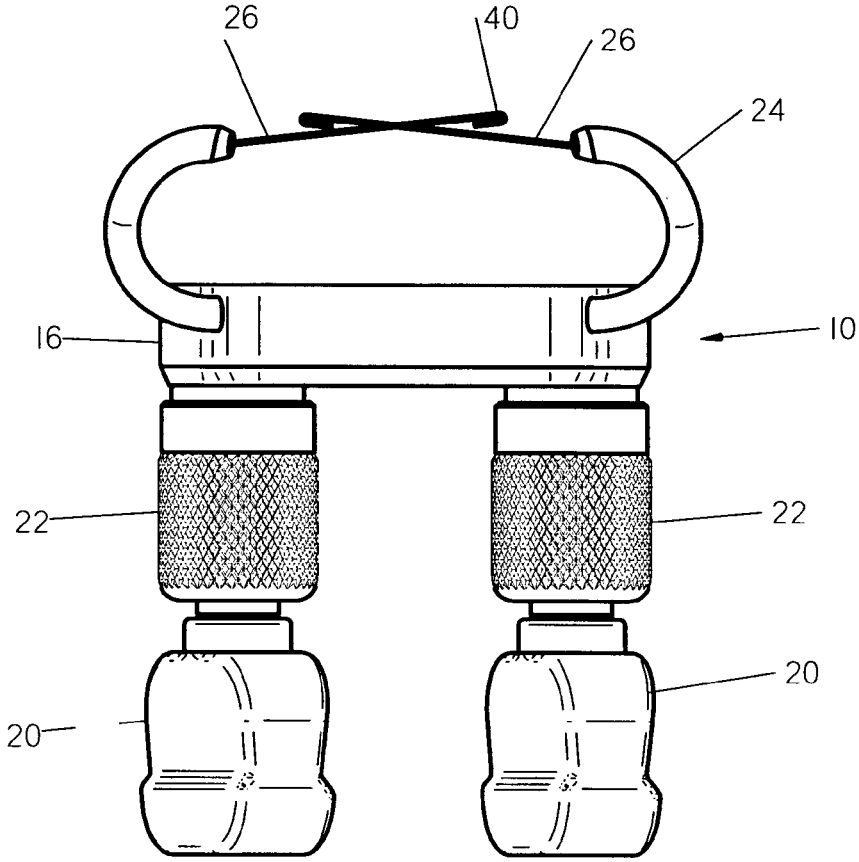
FIG. 10 is a side view of the D-Tuner of FIGS. 1-3.

FIGS. 4 and 5 show base 16 for a D-Tuner 10 of this invention prior to assembly into a D-Tuner, FIGS. 6-8 show a cam peg 18 prior to assembly, and FIG. 9 shows a stop pin 50 prior to assembly. FIGS. 10 and 11 show a D-Tuner 10 as almost completely assembled. The support base 16 has a recessed pocket or cavity 54 in one face and threaded sleeve portions 58 projecting outwardly from the opposite face. The sleeve portions 58 preferably have threads 61 on approximately one half their extent and have smooth end portions 59. The sleeve portions 58 are adapted to have knurled nuts 22 (FIGS. 2 and 10) threaded on them. The nuts 22 preferably have O-Rings (not shown) in them for engaging and sliding against the smooth end portions 59 of the sleeves 59. Holes 60 extend through the sleeves 58 and the base 16 for receiving the cam pegs 18.

The recessed cavity 54 in the base 16 is shaped to receive the cam portions 56 on the end of a cam pegs 17, 18 and has integral stop members 28 projecting into the cavity 54 to limit the extent of turning of the cam pegs 17, 18. The base 16 further preferably has countersink rims 42 around portions of the cavity 54 on both sides of the cavity. These countersink rims 42 are designed to receive and support cover discs 25 (FIG. 3) that partially close the cavity 54 in an assembled base 16.

The base 16 has holes 29 in the cavity 54 for receiving stop pins 50 (FIGS. 9 and 11) that function in tuning the D-Tuner 10 as is explained below. The stop pins 50 have a slip fit with the hole 29 in the base 16 so the pins can easily slide up and down in the holes. The base 16 also has holes 62 through it for receiving screws to secure the D-Tuner 10 on the peghead 12 of a banjo 14, holes 34 for receiving the tubes 24 (and the wires 26 through the tubes), and threaded holes 64 for receiving set screws, not shown, for securing the tubes in the holes 34.

A cam peg 18 for controlling the third G string is shown in FIGS. 6-8 as including a shaft 55 with a cam portion 56 on one end and having a threaded hole 69 in the opposite end to receive a screw 19 (FIG. 2) for securing a button 20 on the cam peg 18. The cam portion 56 of the cam peg 18 has a post or protrusion 57 on it to which one of the wires 26 is secured (FIG. 11). In a preferred embodiment of this invention, the cam peg 17 for controlling the second B string on the banjo is identical to cam peg 18 except for the location of the post 67 on cam peg 17, which is further from the linear axis (axis of turning) of the cam peg 17 than is post 57 on cam peg 18.

In the embodiment selected for illustration, the post 57 on cam peg 18 is 0.10 inch from the turning axis of the cam peg, and post 67 on cam peg 17 is located 0.20 inch from its turning axis. The exact length of the radius from the turning axis of each of the cam pegs 17, 18 is not critical provided the 2 to 1 ratio of the radii is maintained. The 2 to 1 ratio is so that cam peg 17, which tunes the second B-string 30, will adjust the tension on the B-string twice as much as the change in tension on the third G-string 31 by cam peg 18 when the two cam pegs are turned by the same degree of rotation. The change in tension on the second B-string by approximately 100 degrees of rotation of the cam peg 17 is preferably 2 frets in pitch, and the change in tension in the third G-string by approximately the same 100 degrees of rotation of cam peg 18 is 1 fret in pitch. As used herein, one fret in pitch means the difference in pitch when the vibrating section of a banjo string is shortened or lengthened by one fret.

The cam portion 56 of each cam peg 17, 18 is approximately a half circle with a radius 66 on one corner to engage the rounded portion of the stop member 28 in the cavity 54 in the support base 16. The opposite corner 68 of the cam portion 56 has a negative taper on it to engage the tapered end 51 of one of the stop pins 50.

In tuning a banjo and D-Tuner 10 of this invention as is described below, turning of the buttons 20 turn the cam pegs 17, 18 and cam portions 56 on the cam pegs, which in turn moves the posts 57, 67 on the cams portions and pulls or reduces the sideway pull on the wires 26 that are attached to the banjo strings 30 and 31 to change the tension in the strings. The extent of the linear movement of the wires 26 is limited by the cam portions 56 on the cam pegs 17, 18 engagement against the stop pins 50 and the stop member 28 in the base support 16. Turning of either of the two nuts 22 on the base portion clockwise pushes a stop pin 50 axially upwardly in the base portion so the taper 51 on the stop pin will engage the taper 68 on the cam portion 56 sooner to restrict rotation of the cam pegs 17, 18. Turning the nuts 22 counter clockwise lets the stop pins 50 slide downwardly so the keys 20 and cam portions 56 can rotate further in the counter clockwise direction and thereby further reduce the sideway pull of the wires 26 on the strings 30 and 31.

As described above, the knurled nuts 22 on D-Tuner 10 preferably have O-Rings (not shown) in them for engaging and sliding against the smooth portions 59 of the sleeves 58 on the base 16. One purpose of these O-Rings is to prevent lubricants from draining out of the bottom of the tuner 10. Another purpose of the O-Rings is to provide an appropriately tight enough fit of the cam pegs 17, 18 in the base support 16 to provide a slight drag so the cam pegs will not turn or back off the tension in the wires 26 from vibrations or other causes while a musician is playing the banjo, but still be easily turnable by the musician to tune the banjo. A D-Tuner 10 of this invention provides a desirable difference between the static and dynamic torques in turning the nut 22 so as to provide both the ease of tuning and the desired self locking effect. The self locking effect occurs when the adjustment is set and left for a period of time. The torque is high when first turning the key to break the static friction and decreases rapidly as the nut 22 is turned. The type of lubricant used affects these dynamic and static torques. Extreme high pressure lubricants work well for this purpose. Other possible lubricants include chain saw bar oil and white lithium grease.

Figure 13:
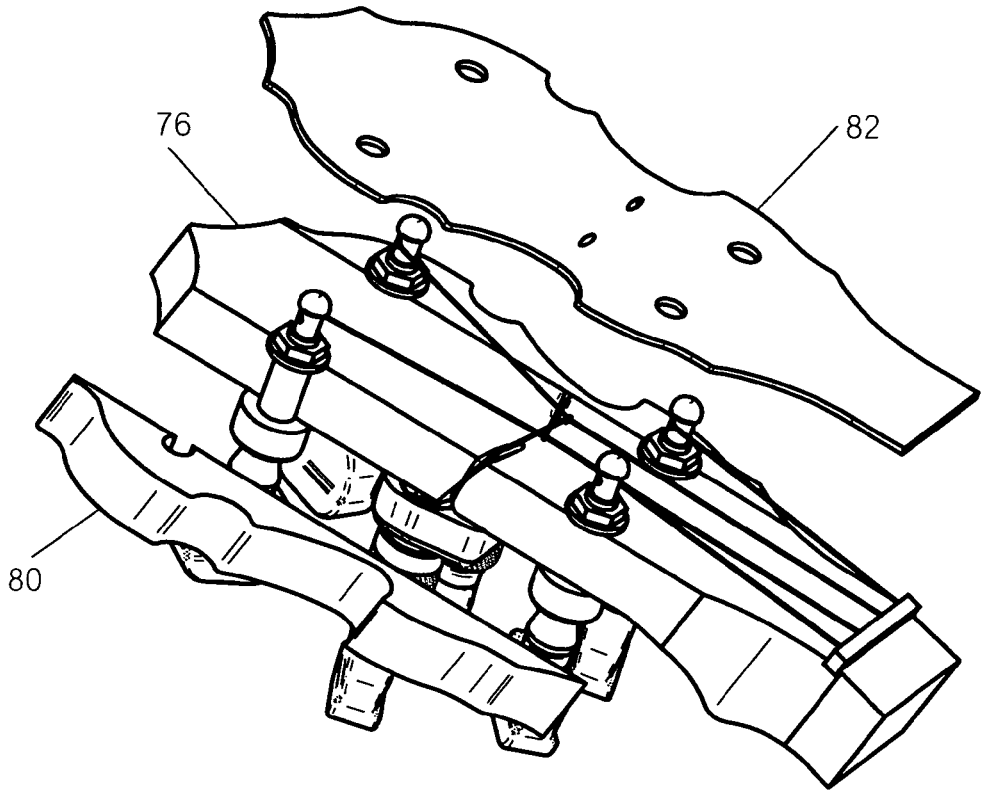
FIG. 13 is an exploded view of the D-Tuner of FIG. 12.
Figure 12:
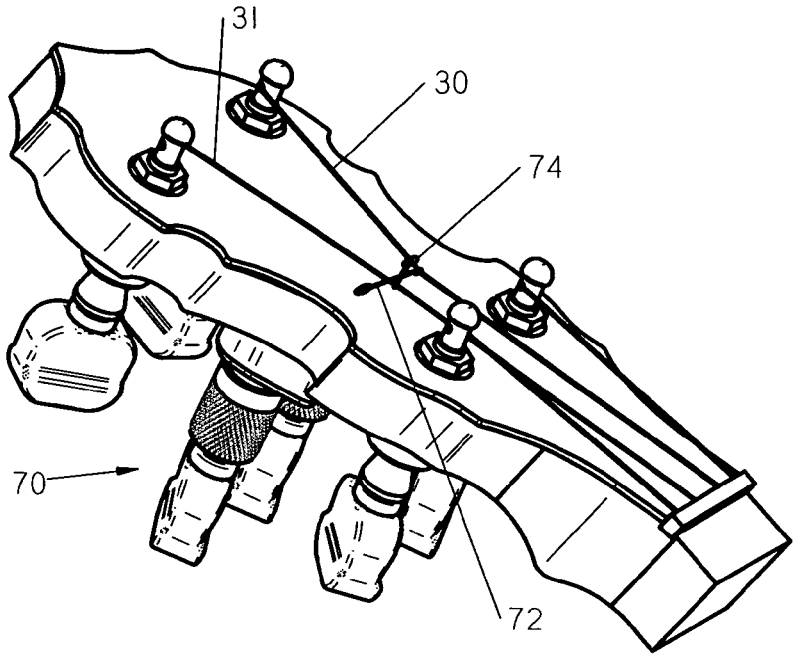
FIG. 12 is a perspective view of an alternative embodiment of a D-Tuner of this invention mounted on a banjo peghead

FIGS. 12 and 13 show an alternative embodiment of a D-Tuner 70 of this invention that avoids the use of tubes 24 of the embodiment 10 described above. Instead of using tubes to guides the wires from the D-Tuner, the flexible members such as wires 72 that extend through holes 74 in the peghead 76 of a banjo. In this embodiment, the holes 74 are preferably formed during manufacture of the banjo. This is best seen in FIG. 13 in which rounded grooves 78 are shown in the near side of the peghead 76 before the peghead ear 80 and peghead overlay 82 are secured on the peghead. In this embodiment the D-Tuner 70 is preferably mounted on the banjo during the manufacture of the banjo so the wires 72 can be positioned between the peghead 76, peghead ears 80 and overlay 82 during the assembly process.

Figure 14:
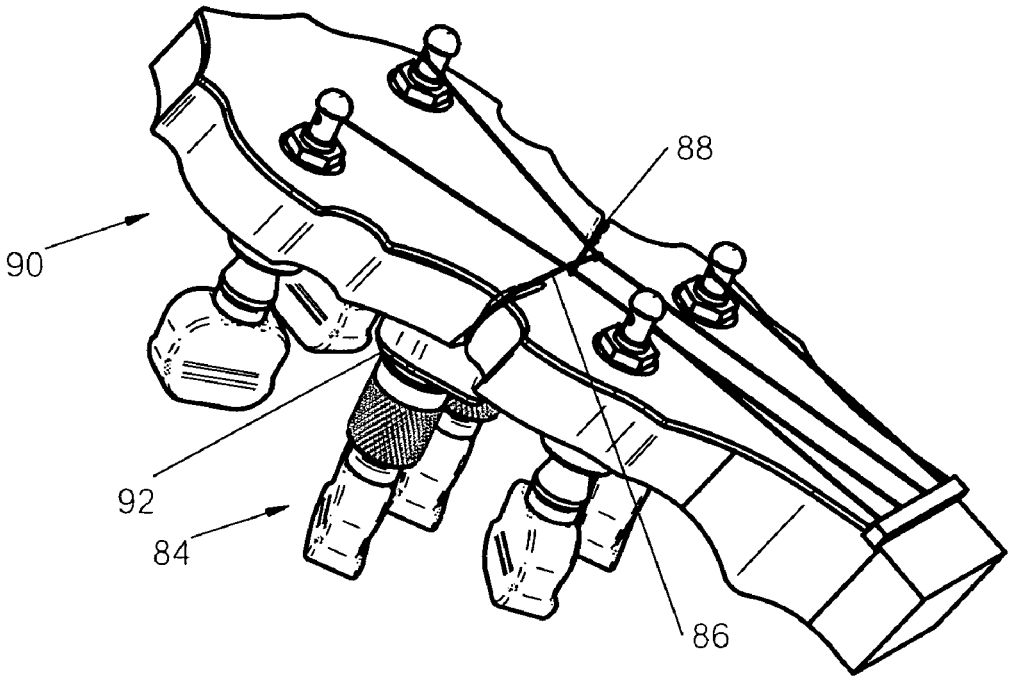
FIG. 14 is a perspective view of another alternative embodiment of a D-Tuner of this invention.

FIG. 14 shows another alternative tubeless embodiment of this invention in which the flexible members (wires) 86 are disposed in small grooves 88 in the outer corner edges of the peghead 90. The wires 86 extend from the support base 92 around opposite side edges of the peghead 90 of a banjo and are guided by the small grooves 88 that have been cut into the peghead. This embodiment is suitable to be mounted on a banjo at any time at a musician's preference.

Figure 15:
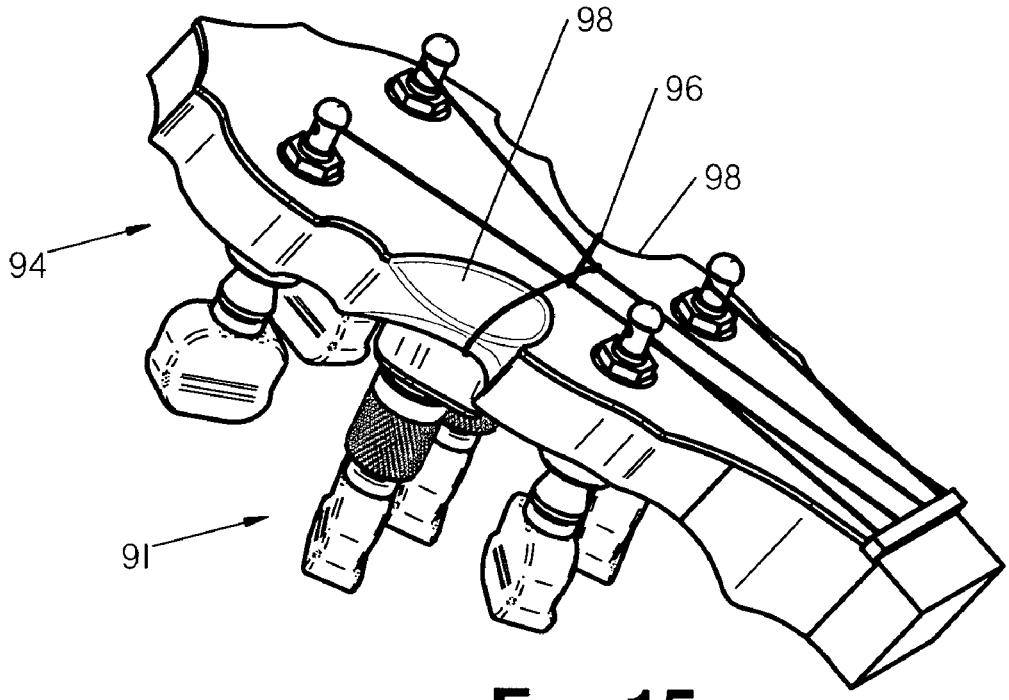
FIG. 15 is a perspective view of another alternative embodiment of a D-Tuner of this invention.

FIG. 15 shows a further embodiment of this invention in which the peghead 94 of a banjo has rounded concave side portions 98 in which the wires 96 of the D-Tuner 91 are seated at the bottom of the rounded concave side portions.

Setting the Stops on a D-Tuner and Tuning a Banjo

In the simplest terms, a musician turns the knurled adjusting nut 22 on a D-Tuner of this invention clockwise to raise the pitch of the string and the opposite direction to lower the pitch. Most musicians know that you should always make the final tuning adjustment by tightening the string or going up in pitch rather than loosening the string or going down in pitch. The musician needs to understand this scientific principle and realize that tuning a banjo with D-Tuners (any D-Tuners) violates this practice.

With a D-Tuner of this invention, the counter clockwise/"G" position stop will always be whatever pitch was initially set using the standard banjo keys and will not be influenced by the D-tuning adjustment. A musician's first step in setting the stops is by turning both key/buttons 20 on the D-Tuner counter clockwise and tuning the banjo with the banjo keys to "G" tuning. The musician next rotates the tuner button 20 clockwise/"D" position to bump against its stop and pluck the string to get the resulting pitch. Next, the musician backs down the adjusting nut 22 on the D-Tuner about a half turn, bumps the stop, and checks the pitch again. This can be repeated several times to get a feel for how the adjustment device works. The musician should be able to feel the adjustment mechanism snap down from one adjustment position to the next and detect the corresponding change in the pitch of the string. This process is continued until the musician reaches the correct pitch for "D" tuning. There is preferably approximately a one eighth inch adjustment range on the nut 22 and the correct D-tuning position should fall somewhere within that range.

It may be surprising to some musicians to learn how little movement is required to noticeably change the pitch of a string. For example, strings can be tuned within +/−1 cents (1% of a half step or one fret in pitch) of the correct pitch by using modern tuners. Some musicians are able to achieve that same level of perfection by ear. But very few people realize how precise the electronic tuner and the human ear can be. For example, laboratory measurements made during the development of a D-Tuner 10 of this invention revealed that it required about 0.012 inch stretch to raise the pitch of a string a half step or one fret or 100 cents. This means that a meaningful error can be detected by stretching the string only 0.00012 inches. That is the thickness of one slice of human hair sliced into 25 pieces.

When the $2^{nd}$ or $3^{rd}$ strings are tuned down to "D" from the "G" tuning, the other strings will go sharp by about 1 to 2 cents. Some choices must be made to address this issue. It is desirable to be able to play with a group in standard 440 tuning in both G tuning and D tuning. However, it is not possible to do that when using D-Tuners. However, there is a strategy that will get the musician close enough that most people will not notice the difference. One strategy is to strike a balance by going about zero cents with all four strings in G-Tuning and then set the $2^{nd}$ & $3^{rd}$ strings at −1 cent in D tuning. This strategy is helpful because when you go to D tuning, the other strings that were previously tuned at zero cent will now drop down to match your D tuning. The goal is to be in standard 440 tuning while playing in G and at −1 cent while in D tuning. Although the tuning will be −1 cent form standard, at least the banjo will be in tune with itself. Fortunately the D-Tuner 10 of this invention is very capable of coping with the necessary precision to achieve this because of the precise design and fits of the fine adjustment and precision internal stops.

Any tuner that pulls the string sideways, as does aD-Tuner 10 of this invention, has a built in advantage over a tuner that pulls the string lengthwise. A D-Tuner 10 of this invention pulls the string sideways 0.100 inch to change the pitch one fret. It requires only 0.012 inch stretch to change the pitch of a string one fret by stretching it. This means that all things being equal, except the direction of pull, a D-Tuner 10 of this invention is 8 times more accurate than one that pulls the string lengthways.

As mentioned above, it is desirable to tune a string by going up in pitch, but it is not possible to do that with D-Tuners. It is tempting to take the easy route and back off the "D" adjustment (the knurled nut 22 in the case of a D-Tuner 10 of this invention) and simply crank the string up to the correct pitch. Unfortunately however, in actual use, the tuner keys must be stopped going down in pitch. The technical term that is at the heart of this problem is "hysteresis", meaning internal friction. This can best be described by recognizing that friction is present when the strings are dragged across the nut 13 located on the upper end of the neck 15. If there were no friction between the string and nut, the tension on the string on both sides of the nut would always be the same. If this were true you could tune the strings by going up or down. Since there is friction however, any time you tune the string up and stop, there is more tension on the string on the peghead side of the nut than there is on the neck side. The amount of the difference in tension is the amount equal to the static frictional force between the nut and string. If you tune the string down, as in D-Tuning, the opposite is true. This difference is quite noticeable and the correct D-Tuning results cannot be achieved without setting the "D" stops with the stings going down.

It is quite acceptable to start out by going either direction with the knurled adjustment nut 22, clockwise to raise the pitch and counter-clockwise to lower the pitch. If a musician starts out too high, he/she just backs down the nut 22, making sure the tuning button 20 comes down with it and then stop when he/she gets to the correct pitch. He/she then makes sure the setting is correct by twisting the button 20 up and back down against the stop, as he/she would in playing, at least one or more times to make sure that the pitch is where the musician wants it. If the musician starts on the low side, he/she simply turns the knurled adjusting nut 22 up slightly past the correct tuning and then back it back down to the correct pitch as described above.

Figure 16:
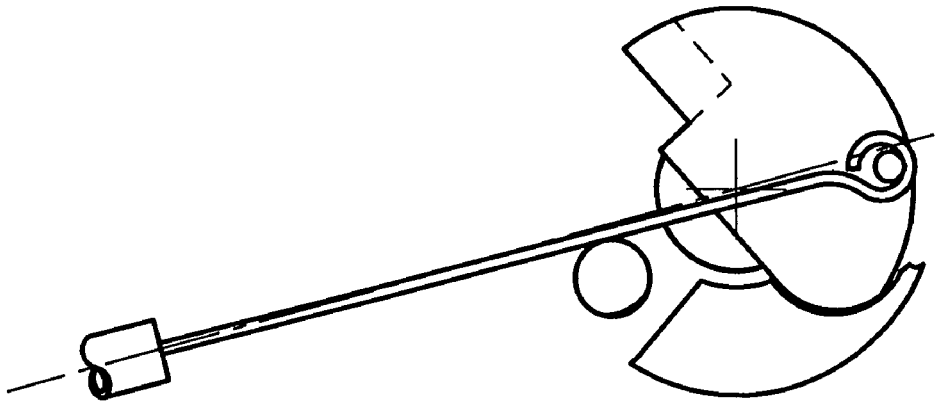
FIGS. 16 and 17 are enlarged fragmentary views of a portion of a D-Tuner of this invention showing functioning of one of the cam pegs and stops in the D-Tuner.
Figure 17:
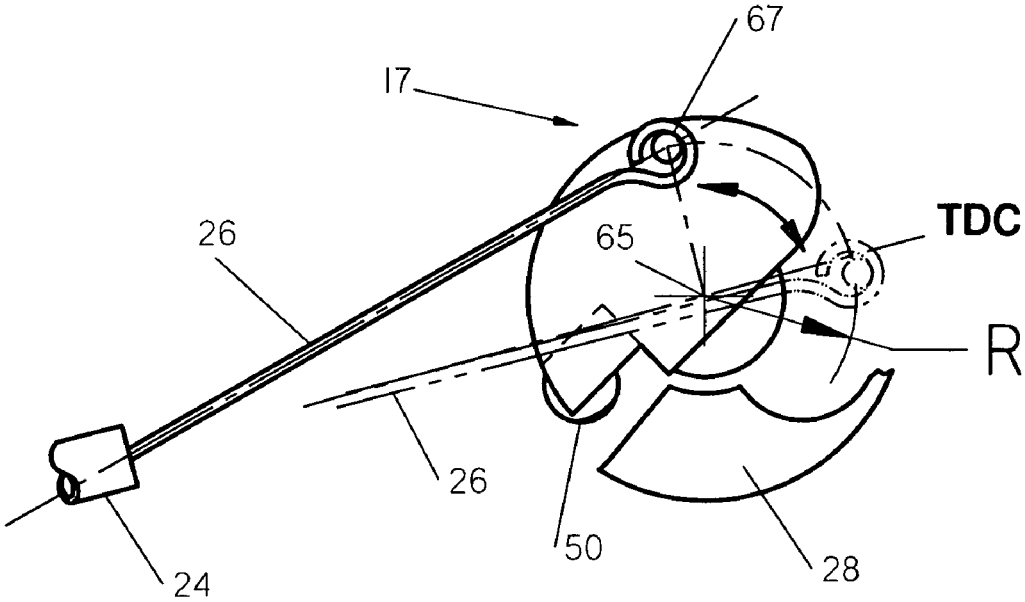

In a preferred embodiment of this invention, the tension in the wires 26 in the D-Tuner holds the cam pegs 17, 18 against the stops in the D-Tuner to insure that the cam pegs don't accidentally back off the stops. This is best seen in FIGS. 16 and 17 which are fragmentary views showing the cam peg 17 and the functioning of the wire 26, post 67, stop pin 50 and solid stop 28. As seen in those Figs., turning of the cam peg 17 clockwise and counter clockwise (see rotational arrows) moves the post 67 in an arc around the turning center 65 of the cam peg. This in turn slides the wire 26, which is attached to the post 67, in and out of the tube. Tension in the wire 26 (from pulling on a banjo string) pulls on the post 67 toward the end of the tube 24. The centerline of the wire 26 swings laterally back and forth with respect to the end of the cam peg 17. FIG. 17 shows the wire (in ghost) at top dead center (TDC) where the wire has been pulled from the end of tube 24 to the maximum extent. At TDC, the centerline of the wire 26 extends through the center 65 of the cam peg 17. When cam peg 17 is turned counter clockwise (as viewed in FIG. 17) and is stopped against stop pin 50, the post 67 on the cam 56 is approximately 90 degrees past TDC. When the cam peg 17 is turned clockwise (as viewed in FIG. 16) and is stopped against the solid stop 28, the post 67 is preferably approximately 10 degrees past TDC. As stated above, the tension in wire 26 acts to hold the cam pegs against the stops and insures that the D-Tuner doesn't back off the stops.

Among the advantages provided by this invention is a natural, variable slurring sound that it produces. Assuming that a musician turns the cam pegs 17, 18 and buttons 20 at a constant turning speed, the velocity of tuning wire 26 movement and change in tension of the banjo strings would be maximum when the posts 57, 67 are at 90 degrees to TDC, would be zero at TDC, and would be progressively faster and slower as the musician turns the cam pegs and buttons opposite directions between the 90 degree position and TDC. This changing speed of change means that the musician gets a natural "variable" slurring sound without trying or even knowing that there is such a thing. This natural variable slurring sound is very pleasing to the ear. Bluegrass music is by nature fast and musicians don't need to be thinking about varying the rotational speed of the keys/buttons in order to achieve the desired result.

It is therefore seen that this invention provides a D-Tuner for quickly, easily and accurately changing the pitch of a banjo to produce a distinctive sound. The D-Tuner of this invention includes keys and flexible members for changing the tension in the second B and third G strings and includes mechanical stops for limiting the adjustment.

Whereas particular aspects of the D-Tuner of this invention have been shown and described for purposes of illustration, it will be appreciated by those skilled in the art that numerous variations of the details may be made without departing from the invention as described in the appended claims. For example, a D-Tuner of this invention could have only one cam peg instead of two and might be used on a stringed instruments other than banjos. A D-Tuner of this invention can also have different stops for limiting the rotation of the tuning buttons and cam pegs. For example the stops could be in the form of adjustable set screws or the like.

What is claimed is:

1. A D-Tuner mounted on a banjo, said banjo including a peghead having two faces and having tuning pegs extending through the peghead, each said tuning pegs having a tuning button on it, said D-Tuner comprising a base secured to the peg head of the banjo on the face thereof having said tuning buttons on it, said base having two keyed cam pegs secured in it, each said cam peg having a cam portion disposed in said base, stops in said base for limiting turning of said cam pegs, a linear flexible member projecting laterally outwardly from each cam peg and around a portion of the peghead, with one end of each flexible member attached to a cam on said at least one cam peg and the distal end of one flexible member attached to the banjo's second B string, and the distal end of the other flexible member attached to the third G string on the banjo for said second B string and third G string to be tuned by turning said keyed cam pegs.

2. A D-Tuner as set forth in claim 1 in which each said flexible member comprises a wire.

3. A D-Tuner as set forth in claim 2 that includes a tube projecting from the base on opposite sides thereof and curving around the edge of the peghead with one of said wires in each tube.

4. A D-Tuner as set forth in claim 3 in which said tubes are secured in holes in said base with one tube in substantial alignment with a cam on one cam peg and the other said tube in substantial alignment with a cam on the other cam peg.

5. A D-Tuner as set forth in claim 1 in which said base is mounted substantially centered between the keys on the peg head.

6. A D-Tuner as set forth in claim 1 in which said stops limit turning of said cam pegs in both the clockwise and counter clockwise directions.

7. A D-Tuner as set forth in claim 6 in which turning of said cam pegs moves said attachment of said flexible members to said cams on an arc between stops on either side of a top dead center (TDC) position of maximum travel of said flexible members.

8. A D-Tuner as set forth in claim 7 in which one stop is at approximately 10 degrees past TDC.

9. A D-Tuner as set forth in claim 1 in which each of said cam portions of said cam pegs has a post projecting from it with one of said flexible members attached to each said post.

10. A D-Tuner as set forth in claim 9 which includes at least one cavity in said base and said stops each comprises said cam portion disposed in said at least one cavity, integral stop members on said base projecting into said cavity for engagement with said cam portion of each cam peg, two adjustment nuts rotatably secured on said base with one of said cam pegs extending through each said nut, and a stop pin projecting into said at least one cavity adjacent each said cam portion, each of said stop pins having a tapered end for engagement with one of said cam portions and each of said stop pins slidably disposed in a hole in said base and having a non-tapered end engaging the undersurface of one of said adjustment nuts so said stop pin will be moved linearly when said nut is turned.

11. A D-Tuner as set forth in claim 1 which is secured to the banjo peghead with screws.

12. A D-Tuner as set forth in claim 1 which is secured to the banjo peghead with double sided adhesive tape.

13. A banjo D-Tuner comprising a base for securement on the peghead of a banjo, said D-Tuner having two cam pegs secured in said base and having linear flexible members projecting laterally from opposite edges of said base with one said flexible member attached to a cam on one of said cam pegs and another said flexible member attached to a cam on the other of said cam pegs.

14. A banjo D-Tuner as set forth in claim 13 in which each said flexible member is a wire.

15. A banjo D-Tuner as set forth in claim 13 which includes stops in said base for limiting the rotation of said cam pegs.

16. A D-Tuner as set forth in claim 15 in which said stops limit turning of said cam pegs in both the clockwise and counter clockwise directions.

17. A D-Tuner as set forth in claim 16 in which turning of said cam pegs moves said attachment of said flexible members to said cams on an arc between stops on either side of a top dead center (TDC) position of maximum travel of said flexible members.

18. A D-Tuner as set forth in claim 17 in which one stop is at approximately 90 degrees from TDC and the other stop is at approximately 10 degrees past TDC.

19. A banjo D-Tuner as set forth in claim 13 which includes tubes projecting from opposite sides of said base and said flexible members extend through said tubes.

20. A mechanical tuner for a stringed instrument having a neck with tuning keys on it for tuning the strings on the instrument, said tuner comprising a base for securement on said neck of the stringed instrument, at least one keyed cam peg secured in said base and extending from the top face of said base, and at least one linear flexible member projecting laterally from one side edge of said base and connected to said cam peg for attachment to at least one string of said stringed instrument to adjust the tension in said string when said cam peg is turned.

21. A tuner as set forth in claim 20 having at least two said cam pegs and at least two linear flexible members attached to said cam pegs.

22. A tuner as set forth in claim 20 in which said linear flexible member is a metal wire.

23. A tuner as set forth in claim 20 that is a D-Tuner and includes stops in said base for limiting the rotation of said cam pegs.

24. A D-Tuner as set forth in claim 23 in which said stops limit turning of said cam pegs in both the clockwise and counter clockwise directions.

25. A D-Tuner as set forth in claim 24 in which turning of said cam pegs moves said attachment of said flexible members to said cams on an arc between stops on either side of a top dead center (TDC) position of maximum travel of said flexible members.

26. A D-Tuner as set forth in claim 25 in which one stop is at approximately 90 degrees from TDC and the other stop is at approximately 10 degrees past TDC.

* * * * *